US005110638A

United States Patent [19]

Vogdes et al.

[11] Patent Number: 5,110,638

[45] Date of Patent: May 5, 1992

[54] MARKER DEVICE WITH PERMANENT INDICIA

[75] Inventors: Christine E. Vogdes, Mountain View; Kris B. Hanson, Newark, both of Calif.

[73] Assignee: Raychem Corporation, Menlo Park, Calif.

[21] Appl. No.: 496,398

[22] Filed: Mar. 20, 1990

[51] Int. Cl.[5] ..... B65D 85/20

[52] U.S. Cl. ..... 428/35.1; 40/316; 101/483; 206/820; 428/36.4; 428/195; 428/323; 428/331

[58] Field of Search ..... 428/323, 331, 35.1, 428/36.4, 195; 206/820; 101/483; 40/316

[56] References Cited

U.S. PATENT DOCUMENTS

| | | | |
|---|---|---|---|
| 3,894,731 | 7/1975 | Evans | 269/47 |
| 4,349,404 | 9/1982 | Changani et al. | 156/86 |
| 4,365,400 | 12/1982 | Carlomagno | 29/235 |
| 4,399,179 | 8/1983 | Minami et al. | 428/331 |
| 4,461,793 | 7/1984 | Blok et al. | 428/36 |
| 4,503,118 | 3/1985 | Murakami et al. | 428/331 |
| 4,610,924 | 9/1986 | Tamagawa et al. | 428/331 |
| 4,865,895 | 9/1989 | Vlamings et al. | 428/35.1 |
| 4,892,787 | 1/1990 | Kruse et al. | 428/331 |
| 4,911,985 | 3/1990 | Jenkins et al. | 428/331 |

FOREIGN PATENT DOCUMENTS

| | | |
|---|---|---|
| 2117270 | 10/1983 | United Kingdom . |
| 2181142 | 4/1987 | United Kingdom . |

*Primary Examiner*—James J. Seidleck
*Attorney, Agent, or Firm*—Edith A. Rice; Herbert G. Burkard

[57] ABSTRACT

Permanent indicia can be applied to a surface comprising a composition comprising about 35 to about 75% of a polymeric component having dispersed therein about 25 to about 65% of a filler component comprising: i) about 2 to about 65% of an insoluble, infusible particulate, active filler having a mean particle size less than about 2.5 micron and a surface area greater than about 10 $m^2/g$: and (ii) up to about 63% of an insoluble, infusible, particulate, inert filler. The polymeric component should be polar, e.g. by the use of a polymer containing polar groups or adding a polar additive to the composition.

19 Claims, 3 Drawing Sheets

MARKER DEVICE WITH PERMANENT INDICIA

BACKGROUND OF THE INVENTION

This invention relates to an article having permanent indicia thereon and to the use of such articles for marking electrical equipment, such as housings, wires and cables. In a preferred embodiment, the article is in the form of a heat stable marker suitable for use in marking cable.

Substrates such as wires, cables, equipment housing and the like are sometimes labeled with marker assemblies comprising a polymeric article marked with indicia, such as letters, numbers, or combinations thereof. To identify large diameter cables, electrical equipment or the like, relatively flat polymeric articles, frequently referred to as cable markers and panel markers, may be used. To identify individual wires, a marker assembly may comprise a sleeve, preferably heat recoverable, of a polymeric material such as a polyolefin, e.g. polyethylene, polyvinyl chloride, nylon or polyvinylidene fluoride. The indicia are generally typed or printed onto the article using a typewriter or computer printer. For many uses, the indicia need to be permanent (i.e. durable), e.g. resistant to smearing, to being rubbed off (i.e. abrasion resistant) and resistant to solvents which may contact the marker, as discussed more fully below. This latter requirement is generally specified for aircraft cable, which may come into contact with hydraulic fluid, liquid fuel, deicing solvents or the like. The mark is generally rendered permanent by a heat treatment. This heat treatment, referred to as "permatization", may take place by placing the sleeve in an oven, subjecting it to infrared radiation or, in the case of heat-recoverable sleeves, by the heat applied during the heat-recovery step. See for example U.S. Pat. No. 3,894,731 to Evans where infrared radiation is used to "permatize" the mark and U.K. Patent Application No. 2,181,142 where the mark is rendered permanent by application of heat during a heat shrinking step. An alternate technique of permanently marking wires, cables or the like is the relatively expensive "hot stamping" technique which requires special, expensive equipment to mark the wire or cable with heated foil.

Approaches for the production of articles with permanent indicia or marks without the need for "permatization" by heat treatment are disclosed in commonly assigned copending applications Ser. Nos. 017,520 and 171,589, filed Feb. 24, 1987 and Mar. 22, 1988, respectively, the entire disclosures of which are incorporated by reference. The former application describes a multilayer article comprising a first substantially nonporous polymeric layer bonded to a second porous absorbent, polymeric layer. The porous layer is capable of being marked with indicia which are resistant to organic solvents, smearing or abrasion. The multilayer article is relatively complicated to manufacture. One method of manufacturing the article is to bond a first layer of polymeric material to a second layer of polymeric material containing a leachable particulate material and then leaching the particulate material from the second layer to render it porous. The latter application describes an article in which the surface has a specified roughness found to be essential for obtaining permanent indicia without the need to heat treat or "permatize". Articles of the same composition but without the specified surface roughness could not be marked with permanent indicia without a "permatizing" treatment.

We have now discovered that an article having a surface made of a polymeric composition containing specified additives, as defined more fully below, is capable of receiving permanent indicia, i.e. indicia resistant to organic solvents, smearing and abrasion, without the need for a "permatizing" treatment.

SUMMARY OF THE INVENTION

One aspect of this invention comprises a marker device comprising: an article having having on at least a portion of a surface thereof a permanent mark, said portion of the surface comprising a composition comprising:

(a) about 35 to about 75% of a polymeric component having dispersed therein about 25 to about 65% of a filler component comprising:
  (i) about 2 to about 65% of an insoluble, infusible particulate, active filler having a mean particle size less than about 2.5 micron and a surface area greater than about 10 $m^2/g$: and
  (ii) up to about 63% of an insoluble, infusible, particulate, inert filler;

with the proviso that if the polymeric component is nonpolar, said composition further contains about 0.1 to about 10% of low molecular weight polar compound, all percentages being by weight based on the weight of the composition.

The terms "permanent" and "permanent indicia" or "permanent mark" as used herein means that the indicia, or marks, are resistant to organic solvents, smearing and abrasion, as discussed more fully below without having been subjected to a "permatizing" step. The degree of permanence required varies depending on the particular application.

The term "active filler" means an insoluble, infusible, particulate filler having a mean particle size less than about 2.5 micron and a surface area greater than about 10 $m^2/g$, such fillers having been found to be active in improving the mark permanence of polymeric compositions containing such active filler.

The term "insoluble, infusible, particulate filler" means a filler in particle form that does not melt or substantially dissolve in the polymer of the polymeric component under processing and use conditions.

The term "inert filler" means a filler which does not have a mean particle size less than about 2.5 micron and a surface area greater than about 10 $m^2/g$, such fillers having been found to have no effect on the mark permanence of a marked polymeric composition containing such inert filler.

Another aspect of this invention comprises a method for producing an article having permanent indicia thereon, which method comprises:

(A) selecting an article having on at least a portion of a surface thereof a permanent mark, said portion of the surface comprising a composition comprising:
  (a) about 35 to about 75% of a polymeric component having dispersed therein about 25 to about 65% of a filler component comprising:
    (i) about 2 to about 65% of an insoluble, infusible particulate, active filler having a mean particle size less than about 2.5 micron and a surface area greater than about 10 $m^2/g$: and
    (ii) up to about 63% of an insoluble, infusible, particulate, inert filler;

with the proviso that if the polymeric component is nonpolar, said composition further contains about 0.1 to about 10% of low molecular weight polar compound, all percentages being by weight based on the weight of the composition; and (B) applying ink to said portion of the surface to obtain permanent indicia thereon.

DETAILED DESCRIPTION OF THE INVENTION

Figure 1:
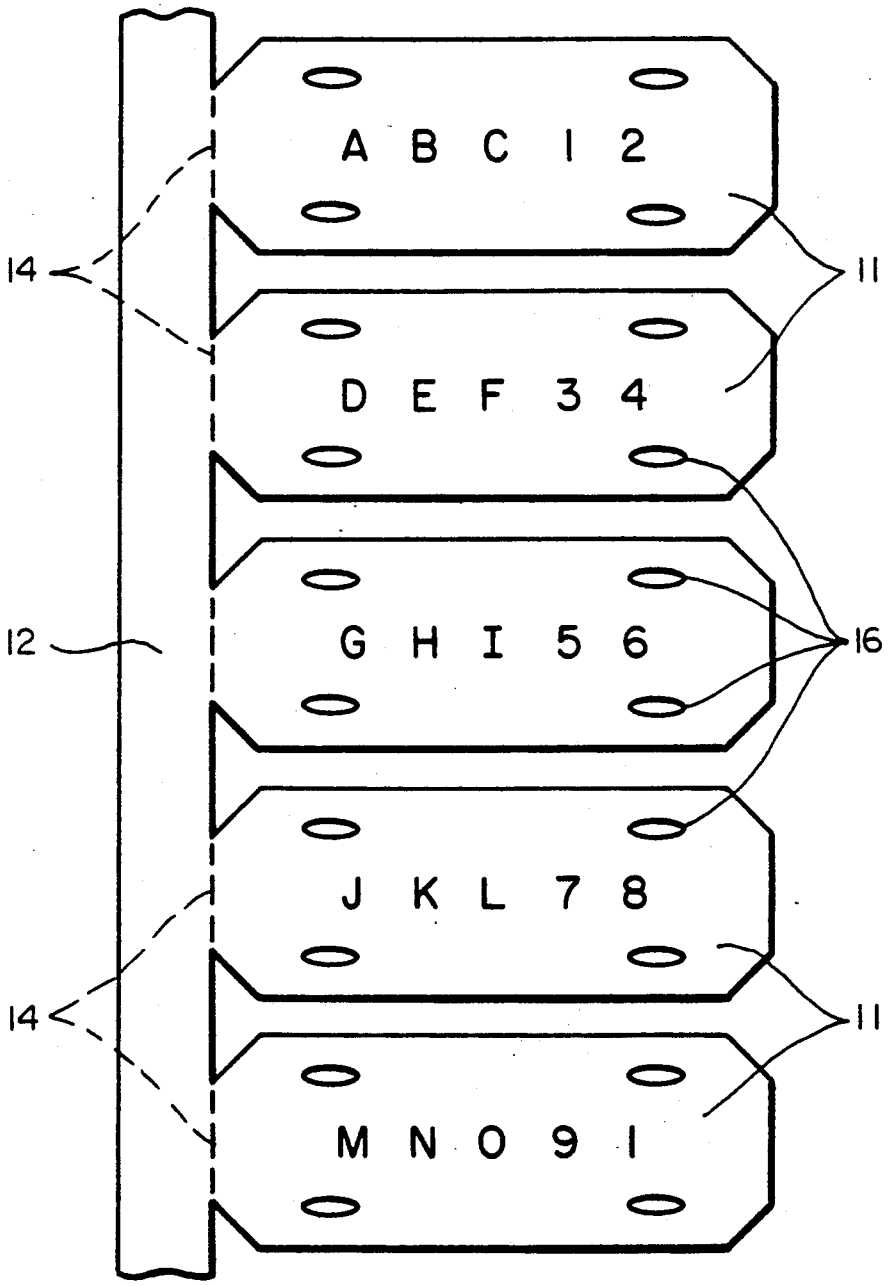
FIG. 1 illustrates a cable marker having permanent indicia thereon in accordance with this invention.

In accordance with this invention the composition of the surface, or the portion thereof to be marked, comprises a polymeric component and a filler component comprising an active filler and, optionally, an inert filler. The composition contains about 35 to about 75% of the polymeric component, preferable about 35 to about 60% and more preferable about 50 to about 60% of the polymeric component. The composition also contains about 25 to about 65% of a filler component (defined more fully below), preferably about 30 to about 55% and more preferable about 40 to about 50% of a filler component. In this patent application including the claims thereof, all percentages are by weight, based on the weight of the composition, unless otherwise specified.

The polymeric component preferably comprises a polar polymer such as polar olefin copolymers, for example, ethylene-alkyl acrylate copolymers, such as ethylene-methyl acrylate and ethylene-ethyl acrylate copolymers, ethylene methacrylic acid copolymers, ethylene-vinyl acetate and blends of these polymers with each other or with other polymers Preferably, such blends contain at least about 50% polar polymer so that the major phase of the polymeric component is polar. Nonpolar polymers can be used in the polymeric component in blends with a polar polymer in which the polar polymer predominates or a low molecular weight polar compound can be added to the nonpolar polymer. Nonpolar polymers include polyethylene, ethylene-propylene co- or terpolymers and the like.

The insoluble, infusible, particulate, active filler has a mean particle size less than about 2.5 microns, preferably between about 0.01 to about 2.5 microns and a surface area greater than about 10 $m^2/g$ preferably between about 10 and about 300 $m^2/g$, more preferable between about 15 and about 200 $m^2/g$. The composition contains about 2 to about 65% of the active filler, preferably about 5 to about 45% and more preferable about 10 to about 20% active filler. The active filler, in addition to having the specified mean particle size and a surface area, preferably has an irregular configuration, for example, it can be in the form of flakes, platelets, or the like. Mixtures of active fillers can be used to obtain the desired degree of mark permanence. The active filler also preferably has an oil absorption of greater than about 30, more preferably greater than about 40 and most preferable greater than about 200 grams per 100 grams of filler. Illustrative active fillers are talc, clay, fumed or precipitated silica, aluminosilicates, and the like, having the specified particle size and surface area. Two or more active fillers can be used if desired.

The composition optionally contains up to about 63% of the inert filler, preferable about 5 to about 60%, more preferable about 10 to about 50% and most preferably about 20 to about 40% of the inert filler. The particle size and surface area of the inert filler is not critical. Illustrative inert fillers are calcium carbonate (having a particle size and/or surface area such that it is not an active filler) powdered PTFE, flame retardants such as decabromodiphenyl ether, perchloropentacyclodecane, 2,2-bis (tetrabromophthalimido) ethylene, inorganic fillers such as titanium dioxide, antimony trioxide, zinc hydroxide, zinc borate, zinc oxide, zinc sulfide, magnesium hydroxide, basic magnesium carbonate, iron oxide, and the like. Two or more inert fillers can be used if desired.

The polymer composition can contain soluble, fusible additives in addition to the active and inert insoluble fillers, if desired. Such additives include for example, antioxidants such as alkylated phenols, e.g. those commercially available as Goodrite 3125, Irganox 1010, Irganox 1024, Irganox 1035, Irganox 1076, Irganox 1093, Vulkanox BKF, organic phosphite or phosphates, e.g dilauryl phosphite, Mark 1178, organic sulfides, such as, dilauryl thio-dipropionate, e.g. Carstab DLTDP, dimyristyl thiodipropionate, e.g. Carstab DMTDP, distearyl thiodiproporionate, e.g Cyanox STDP, amines, e.g. Wingstay 29 etc; UV stabilizers such as [2,2'-thio-bis(4-t-octylphenolato)] n-butylamine nickel, Cyasorb UV 1084, 3, 5-ditertiarybutyl-p-hydroxybenzoic acid, W Chec Am-240; processing aids, e.g. zinc stearate, silicone oils/resin; crosslinking agents as promoters, such as organic peroxides, e.g. dicumyl peroxide, triallyl cyanurate, triallyl trimellitate, trimethylol propane trimethacrylate, triallyl isocyanurate and the like. Mixtures of such additives can be used if desired.

It has further been found that if the major phase of the polymeric component is nonpolar, for example if the polymeric component contains more than 50% high density polyethylene, the composition should also contain a low molecular weight polar compound. The low molecular weight polar compound is present in an amount of about 0.1 to about 10%, preferably about 1 to about 5% and more preferably about 2, to about 4%. Illustrative low molecular weight polar compound which may be used include hindered phenols, e.g. phenolic antioxidants, acrylates, such as trimethylol propane trimethacrylate, phthalates, such as dioctyl phthalate, cyanurates, such as triallyl cyanurate, and isocyanurates, such as triallyl isocyanurate, and other compounds containing one or more polar groups.

The surface roughness of the surface to be marked is not critical. The surface can be relatively smooth or can have the degree of roughness specified in copending application Ser. No. 171,589 filed Mar. 22, 1988, mentioned above and incorporated herein by reference, or can have an intermediate degree of roughness. In general, however, the rougher the surface the higher the degree of mark permanence.

The marked device of this invention need not be subjected to a heat treatment (i.e. "permatization") to render the mark (or indicia) permanent (as defined herein). In general, however, if the marked article is subjected to a heat treatment the mark will have a higher degree of permanence.

Figure 2:
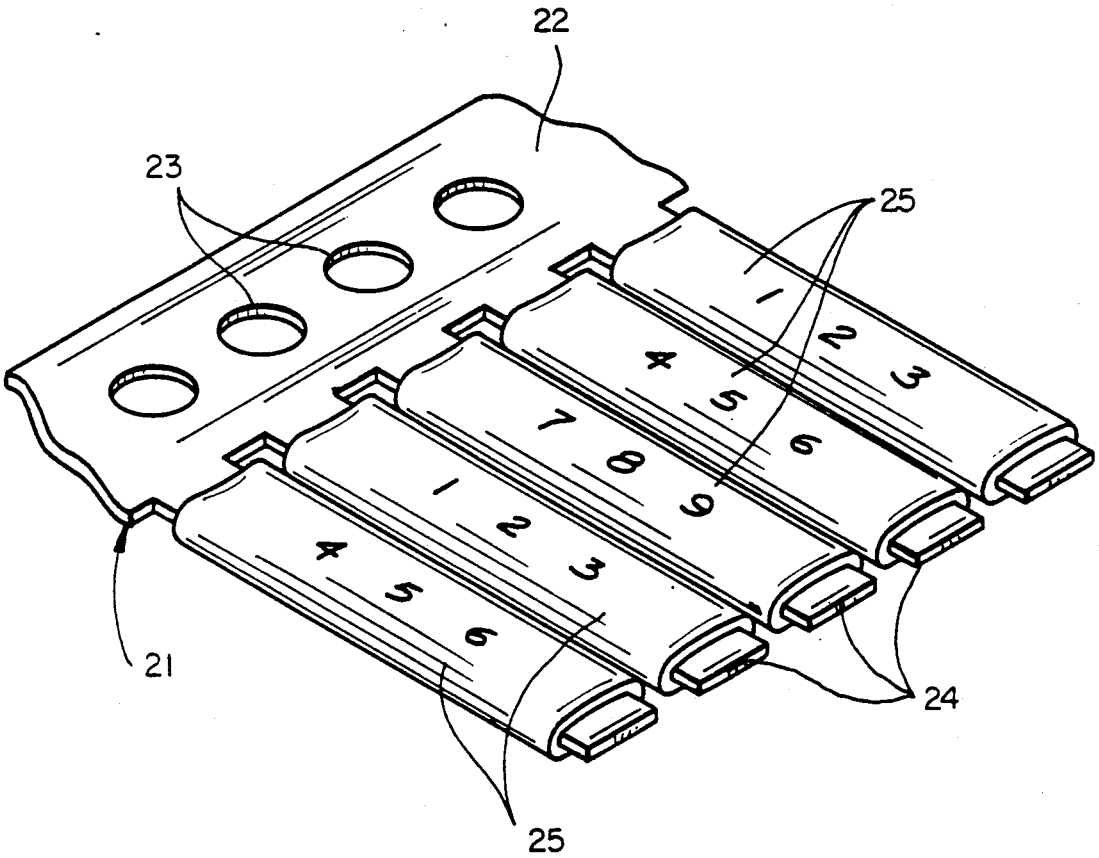
FIG. 2 illustrates heat recoverable marker sleeves on a bandolier and having permanent indicia thereon in accordance with this invention.
Figure 3:
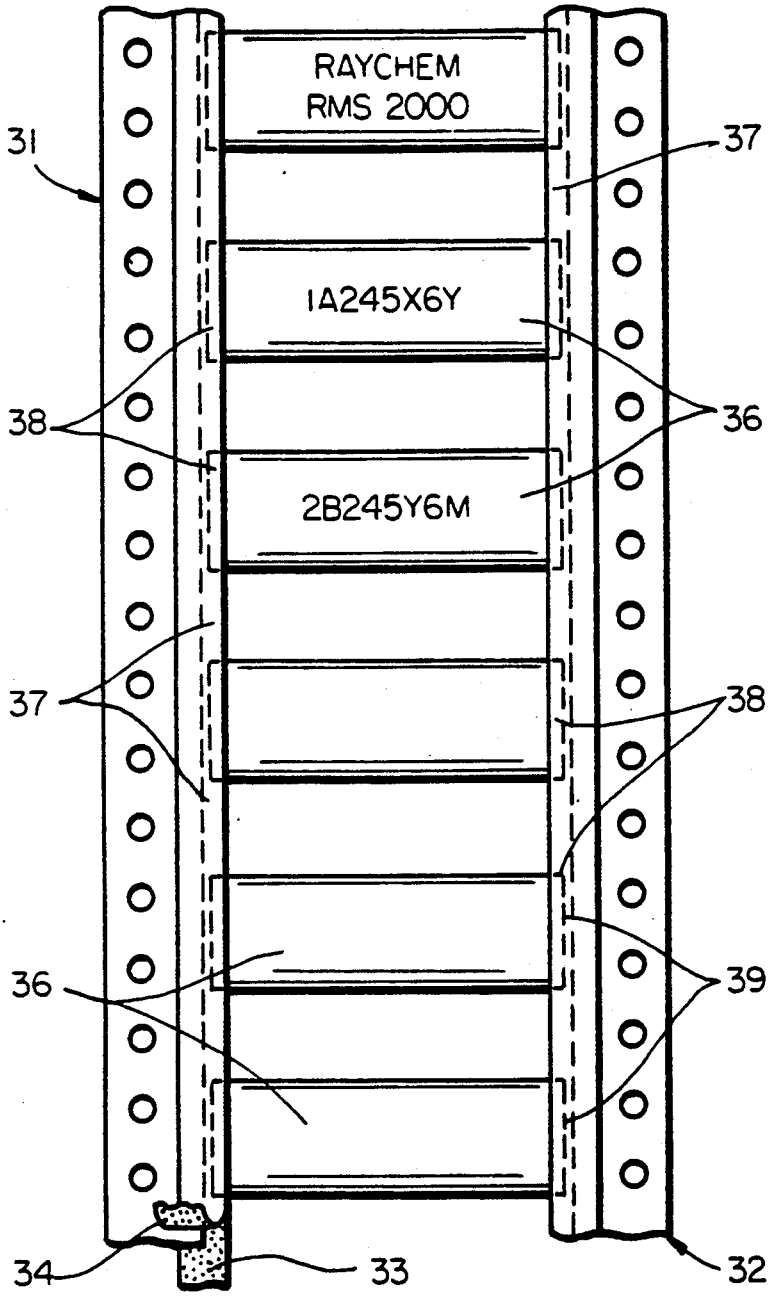
FIG. 3 illustrates another arrangement of heat recoverable maker sleeves having permanent indicia thereon in accordance with this invention.

The marker device can be in the shape desired for the intended use. It can be in the form of a package or label for use on a package or other substrate to be marked. For application to large diameter cable equipment housings and the like, the marker device is generally a substantially flat sheet, as shown in FIG. 1 discussed more fully below. For application to individual wires and relatively small diameter cables, the article is preferably in the form of a tubular article, preferably heat-recoverable, as shown in FIGS. 2 and 3 (discussed more fully below).

Heat-recoverable articles are articles, the dimensional configuration of which may be made substantially to change when subjected to heat treatment. Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962, 3,086,242 and 3,597,372.

In the production of heat-recoverable articles, the polymeric material may be crosslinked at any stage in the production of the article that will enhance the desired dimensional recoverability. One manner of producing a heat-recoverable article comprises shaping the polymeric material into the desired heat-stable form, subsequently crosslinking the polymeric material, heating the article to a temperature above the crystalline point or, for amorphous materials the softening point, as the case may be, of the polymer, deforming the article and cooling the article whilst in the deformed state so that the deformed state of the article is heat-unstable, application of heat will cause the article to assume its original heat-stable shape.

The crosslinking can be effected by chemical means, e.g. with peroxides, or by irradiation or a combination of the two. Radiation employed can be of various types including charged particles, e.g. alpha particles or high energy electrons and electromagnetic radiation, e.g. gamma or ultraviolet radiation. Radiation doses of any desired amount can be used, although generally a dosage of from 1 to 50, preferably 2 to 20 Mrads will be sufficient.

Illustrative processes for the preparation and use of marker devices can be found, for example, in U.S. Pat. Nos. 3,894,731, 4,349,404, 4,365,400 and 4,865,895, the entire disclosures of which are incorporated herein by reference. Typical marker devices of this invention are shown in the accompanying drawings.

FIG. 1 illustrates an embodiment of a marker device which is an assembly of cable markers 11 detachable secured to support structure 12. In the illustrated embodiment the cable markers and support strip have been formed from an extruded sheet of a polymeric composition in accordance with this invention and stamping the desired shape. Perforations 14 are provided where the cable markers join the support for easy separation of the markers. Typically, the assembly is fed through a typewriter or printer and the indicia are applied. The individual cable markers are the removed when needed and secured to the cable to be identified with a cable tie inserted through holes 16 provided in each marker. The cable marker is not heat shrinkable and in accordance with this invention no heating step is required to render the mark permanent. Cable marker assemblies of this type can also readily be formed from a molded plaque of a polymeric composition containing an active filler as taught herein.

FIG. 2 shows a marker device which is an assembly comprising a bandolier or comb like support structure 21 having a spine 22 that is provided with a number of sprocket holes 23, and an array of bars 24 that extend from one side of the spine 22. Each bar 24 has a heat recoverable sleeve 25 partially recovered thereon.

The assembly can be fed into a conventional typewriter or printer, with suitable modification to the typewriter on printer platten, and a flat surface of each heat-shrinkable sleeve will be presented to the printer head in correct register for printing indicia on the assembly. After printing the sleeve is slipped onto a wire or other object to be marked and heated to recover the sleeve onto the substrate.

FIG. 3 illustrates another embodiment of the marker device of the present invention wherein carrier strips 31, 32 are separate strips and the adhesive means is provided by opposing tapes 33, 34 having adhesive surfaces to engage carrier strip 31 and the end portions of marker sleeves 36. Opposing adhesive tapes 33, 34 bond to each other in regions 37 and bond to the opposite sides of the end portions of flattened tubular marker sleeves in regions 39. Tapes 33, 34 engage the carrier strip 31 along the inner portion of carrier strip 31 and along its entire length. Adhesive strips 33, 34 can be segmented or perforated or discontinuous which in some cases will aid in the ease of removal of the marker sleeves from the marker sleeve assembly provided that sufficient bonding in regions 37, 39 are achieved by the lengths of tapes 33, 34 which are used.

In normal configuration the inner edge of carrier strips 31, 32 are adjacent to the ends of the flattened tubular marker sleeves and the adhesive tapes 33, 34 cover the area of each as explained above. However, in some configurations it may be desirable to leave a space in region 38 between the inner edge of carrier strip 31 and the end of marker sleeve 36 to allow the opposing adhesive surfaces of opposing tapes, 33, 34 to bond to each other along and adjacent to the ends of marker sleeves 36 to further aid in holding the flattened tubular marker sleeves 36 in the desired position and aid in holding the flattened marker sleeves in the desired flattened configuration.

The indicia are applied to the surface using conventional inks. Conventional inks typically contain a vehicle comprising a solvent and optionally a binder, pigment particles, for example carbon black, together with a dye soluble in the ink vehicle. Such dyes include, for example, nigrosine and induline dyes. The indicia can be in the form of alpha-numeric characters, bar codes or the like and can be applied by any printer typically used for applying such indicia.

Indicia, or marks applied to the surface in accordance with this invention are permanent without the need for a heat treatment step. For certain uses, for example to mark wire and harnessing for military use, resistance to organic solvents and abrasion is of paramount importance. In this regard, it is necessary for the marked article to meet the requirements of Military Specification MIL-M-81531 and Military Standard MIL-STD-202, both of which are incorporated by reference herein. With respect to abrasion, Military Specification MIL-M-81531 requires that the markings or indicia be readable after being rubbed with an eraser 20 times.

With respect to resistance to organic solvents, Military Standard MIL-STD-202 requires that the marks of indicia be readable after being immersed in a variety of organic solvents and then brushed with a toothbrush. These organic solvents include: mixtures of isopropyl alcohol and mineral spirits; an azeotrope mixture of trichlorotrifluroethane (FREON TF, a registered trademarks of E. I. DuPont de Nemours) and methylene chloride; 1,1,1-trichloroethane; and an aqueous solution of butyl cellosolve and monoethanolamine.

In addition to meeting the requirements of Military Standard MIL-STD-202, it is preferred that the markings or indicia be resistant to removal during prolonged immersion in the following organic solvents: JP-4 fuel (kerosene), Skydrol (a phosphate ester hydraulic fluid available from Monsanto Company), hydraulic fluid (petroleum based), aviation gasoline, lubricating oil (ester based) and anti-icing fluid (an aqueous mixture of glycols). These organic solvents are further specified in the Raychem Corporation Specification RT-1800/2, which is incorporated by reference herein.

It is, of course, anticipated that the marked article according to the invention will be resistant to many other organic solvents as well as many inorganic solvents.

It should be understood, then, that whenever throughout this specification the markings or indicia are stated to be permanent or durable they are resistant to organic solvents, smearing and abrasion, such resistance to organic solvents, smearing and abrasion shall be defined as indicated above.

The following examples illustrate the preparation of articles in accordance with this invention.

EXAMPLES 1-23

Formulations were prepared containing 51% of an ethylene-methyl acrylate copolymer, 8% of a mixture of a crosslinking promoter, stabilizer and processing aid, 41% of insoluble, infusible fillers including an inert filler mixture (IF) of decabromodiphenyl ether, antimony trioxide and other flame retardants and an active filler. Table 1 gives the identity of active fillers used and Table 2 gives the amount of active filler used in each example. (Some of the fillers in Table 1 were found not to be active fillers and do not have the required particle size and surface area). The formulations were compounded in a Banbury, pelletized and extruded into 2" wide tapes. The control formulated contained 41% inert filler. Comp. 1, a comparative formulation contained 15% of filler L, an aluminosilicate having a mean particle size greater that that found to be necessary for obtaining mark permanence, together with the inert filler. This can be compared to Example 2 which contains 15% of an aluminosilicate having a particle size less than about 2 micron.

The extruded tapes were marked using standard IBM printer and ink. The permanence of the mark was tested according to Mil 81531, mentioned above, using Skydrol (after 24 hour immersion in room temperature Skydrol), Solvent A (mixture of isopropyl alcohol and mineral spirits), and solvent B (1,1,1-trichloroethane) as defined in Mil. Std. 202. The results of this testing is shown in Table 2, where the mark after testing is rated on a scale of 1-5, where 1=No evidence of Mark
2=Some Mark but completely unreadable
3=Marginal fail
3=Marginal pass
4=Strong pass
5=Retention of original mark quality.

The times indicated in Table refer to the time elapsed between printing and solvent or fluid immersion.

TABLE 1

| Filler Number | TYPE | PARTICLE SIZE (micron) | OIL ABS. g/100 g | SURFACE AREA $m^2/g$ | SHAPE | |
|---|---|---|---|---|---|---|
| A | Fumed Silica | 0.01 | | 150 | spherical | surface treated |
| B | Fumed Silica | 0.02 | | 110 | spherical | surface treated |
| C | Fumed Silica | 0.01 | | 170 | spherical | surface treated |
| D | Silica | 1.80 | 29 | 6.3 | microcrystalline | micronized |
| E | Ppt. Silica | 0.02 | 300 | 150 | spherical | synth. amorphous |
| F | Clay | 1.80 | 60 | 5.1 | | calcined |
| G | Clay | 1.00 | 45 | 13.9 | plate 11:1 | delaminated kaolin |
| H | Clay | 0.40 | 43 | 18-26 | | water fractionated |
| I | Clay | 0.40 | 43 | 18-26 | | surface treated |
| J | Talc | 2.20 | 38 | 17 | plate | magnesium silicate |
| K | Aluminosilicate | 1.00 | 365 | | porous, irregular | treated diatomaceous earth |
| L | Aluminosilicate | 3.50 | 100 | | porous, irregular | crushed diatomaceous earth |
| M | Mica | 2.00 | | | rhombohedral | dry ground |
| N | Wollastonite | 7.00 | 22 | 1.9 | Acircular | 5:1 aspect ratio |
| O | $CaCO_3$ | 2.00 | 16 | 2.5 | rhombohedral | surface treated |

TABLE 2

| Example | Active filler, % | Skydrol 1 hr | Skydrol 4 hr | Skydrol 24 hr | Solvent B 1 hr | Solvent A 1 hr |
|---|---|---|---|---|---|---|
| Control | none | 1 | 2 | 2 | 2 | 2 |
| Comp. 1 | L, 15% | 1 | 3 | — | 3 | 2 |
| 1 | K, 5% | 1 | 4 | 5 | 4 | 4 |
| 2 | K, 15% | 5 | 5 | 5.5 | 4.5 | 5 |
| 3 | A, 15% | 1 | 3 | 4 | 5.5* | 5 |
| 4 | C, 15% | 1 | 3. | 3.5 | 5.5* | 5 |
| 5 | B, 15% | 1 | 3.5 | 4.5 | 5* | 4.5 |
| 6 | D, 15% | 1 | 3.5 | 4 | 3.5 | 3.5 |
| 7 | E, 15% | 2 | 4* | 4 | 5.5* | 4.5 |
| 8 | G, 2% | 3 | 4 | 5 | 4 | 4 |
| 9 | G, 10% | 4 | 4.5 | 5.5 | 4 | 4 |
| 10 | G, 15% | 2 | 5 | 5.5 | 4.5 | 4.5 |
| 11 | H, 2% | 2 | 4 | 5 | 4 | 4 |
| 12 | H, 10% | 4 | 5 | 5.5 | 4.5 | 4.5 |
| 13 | H, 15% | 2 | 5 | 5.5 | 5* | 5.5 |

TABLE 2-continued

| Example | Active filler, % | Skydrol 1 hr | Skydrol 4 hr | Skydrol 24 hr | Solvent B 1 hr | Solvent A 1 hr |
|---|---|---|---|---|---|---|
| 14 | I, 15% | 1 | 5 | 5 | 5* | 4.5 |
| 15 | F, 15% | | 4.5 | | | 2 |
| 16 | F, 20% | 2-3 | 4 | 4 | 2 | 2 |
| 17 | J, 15% | 4.5 | 5 | 5.5 | 4.5 | 4 |
| | J, 20% | 4 | 4 | 4.5 | 4.5 | 4 |
| 18 | O, 20% | 2-3 | — | — | 2 | 2 |
| 19 | M, 10% | 1 | 3 | 4 | 3.5 | 2 |
| 20 | N, 10% | 1 | 3 | 3.5 | 4 | 3.5 |
| 21 | N, 15% | 1 | 3 | 3.5 | 3.5 | 3.5 |
| 22 | | | | | | |

*Slightly blurred print due to ink bleeding

**Blurring due to surface roughness

EXAMPLES 23-58

Formulations were prepared on a Brabender and pressed into slabs using various base resins, the same inert filler (IF) mixture as in the previous examples and additives as indicated in Table 4. The following abbreviations were used for the resins:

Resin 1=low density polyethylene having a melt flow index of 2.2 and a density of 0.920.

Resin 2=ethylene/vinyl acetate copolymer containing 18% vinyl acetate and a melt flow index of 2.5.

Resin 3=high density polyethylene having melt flow index of 0.15 and a density of 0.946.

Resin 4=very lower density polyethylene having a melt flow index of 1.0 and a density of 0.905.

Resin 5=ethylene/vinyl acetate copolymer containing 25% vinyl acetate and a melt flow index of 2.0.

Resin 6=ethylene/methyl acrylate copolymer containing 15% methyl acrylate and having a melt flow index of 0.7.

The slabs were irradiated in an electron beam accelerator to a dose of 10 Mrad. The slabs were then printed with an IBM Proprinter dot matrix printer. The samples were tested for mark permanence in Solvent A according to Mil-STD-202 and in Skydrol according to Mil-M-81531.

TABLE 3

| EXAMPLE | RESIN | FILLER* | WT % | SKYDROL 4 HR | SKYDROL 24 HR | PRINT PERFORMANCE SOLV A 1 HR |
|---|---|---|---|---|---|---|
| 25 | ½ blend** | IF | 45 | 3.5 | 4.5 | 2 |
| 26 | ½ | IF/J/E | 30/7.5/7.5 | | | 2 |
| 27 | ½ | F | 45 | 3 | 4 | 1 |
| 28 | ½ | O | 45 | 3.5 | 5 | 1 |
| 29 | 3 | IF | 45 | 1 | 1 | 1 |
| 30 | 3 | IF/J/E | 30/7.5/7.5 | 1 | 1 | 1 |
| 31 | 1 | IF | 45 | 2 | | 1 |
| 32 | 1 | IF/J/E | 30/7.5/7.5 | 3.5 | | 1 |
| 33 | 4 | IF | 45 | 4 | | 1 |
| 34 | 4 | IF/J/E | 30/7.5/7.5 | 5 | | 1 |
| 35 | 5 | IF | 45 | 4 | | 2 |
| 36 | 5 | IF/J/E | 30/7.5/7.5 | 5 | | 5 |
| 37 | 2 | IF | 45 | 5 | 5 | 3.5 |
| 38 | 2 | IF/J/E | 30/7.5/7.5 | 5.5 | 5.5 | 5 |
| 39 | 6 | IF | 45 | 5 | 5 | 3 |
| 40 | 6 | IF/J/E | 30/7.5/7.5 | 5.5 | 5.5 | 5 |
| 41 | 6 | IF/J/E | 35/5/5 | 5.5 | 5.5 | 5 |
| 42 | 6 | IF/J/E | 25/10/10 | 5 | 5.5 | 5 |
| 43 | 6 | IF/J | 35/10 | 5.5 | 5.5 | 5 |
| 44 | 6 | IF/J | 25/20 | 5.5 | 5.5 | 5 |
| 45 | 6 | IF/E | 35/10 | 5 | 5.5 | 5 |
| 46 | 6 | IF/E | 25/20 | 4.5 | 5 | 5 |
| 47 | 6 | K | 25 | 4 | 5 | 3.5 |
| 48 | 6 | | 45 | 5 | | 4 |
| 49 | 6 | E | 25 | 2 | 4 | 3 |
| 50 | 6 | | 45 | 2 | | 5 |
| 51 | 6 | G | 25 | 4.5 | 5 | 4 |
| 52 | 6 | | 45 | 4.5 | | 5 |
| 53 | 6 | J | 25 | 4.5 | 5 | 3 |
| 54 | 6 | | 45 | 4.5 | | 4 |
| 55 | 6 | O | 25 | 4.5 | 4.5 | 2 |
| 56 | 6 | | 45 | 4.5 | | 4 |
| 57 | 6 | D | 25 | 3 | 4.5 | 2 |
| 58 | 6 | | 45 | 3 | | 2 |

*inert fillers are designated IF, the active fillers are as identified in Table 1

**the blend contained more than 50% of 1, a nonpolar resin.

EXAMPLES 59-64

Formulations were prepared using the nonpolar resins 3 and 4, defined above, or a blend of nonpolar resin 3 with a minor amount of polar resin 6, the same inert filler (IF) mixture as in the previous examples and polar additives (PA1=phenolic antioxidant, PA2=triallyl isocyanurate and PA3=trimethylol propane trimethacrylate) in amounts specified in Table 4. Each formulation contained active fillers J and E (see Table 1). Samples were prepared and tested for mark permanence in Solvent A as described above. The results are shown in Table 4. The results show that the mark permanence of a nonpolar resin is improved by the addition of a polar compound.

TABLE 4

| Ex. No. | Resin 3 | Resin 4 | Resin 6 | IF | J | E | PA1 | PA2 | PA3 | Solv A |
|---|---|---|---|---|---|---|---|---|---|---|
| 59 | 36.0 | 19.0 | — | 28.4 | 8.3 | 8.3 | — | — | — | 1 |
| 60 | 34.9 | 18.5 | — | 27.5 | 8.0 | 8.0 | 3.0 | — | — | 4 |

TABLE 4-continued

| Ex. No. | Resin 3 | Resin 4 | Resin 6 | IF | J | E | PA1 | PA2 | PA3 | Solv A |
|---|---|---|---|---|---|---|---|---|---|---|
| 61 | 35.0 | 18.5 | — | 27.6 | 8.1 | 8.1 | — | 2.7 | — | 3.5 |
| 62 | 34.9 | 18.4 | — | 27.5 | 8.1 | 8.1 | — | — | 3.0 | 5 |
| 63 | 36.0 | — | 19.0 | 28.4* | 8.3 | 8.3 | — | — | — | 1 |
| 64 | 34.9 | — | 18.4 | 27.5* | 8.1 | 8.1 | 3.0 | — | — | 3.5 |

We claim:

1. A marker device comprising: an article having on at least a portion of a surface thereof a permanent mark, said marker device comprising an article formed by extruding a composition comprising:

a. about 35 to about 75% of a polymeric component having dispersed therein about 25 to about 65% of a filler component comprising:

i. about 2 to about 65% of an insoluble, infusible, particular, active filler having a mean particle size less than about 2.5 micron and a surface area greater than about 10 $m^2/g$; and ii. up to about 63% of an insoluble, infusible, particulate, inert filler;

with the proviso that if the polymer of the polymeric component is nonpolar, said polymeric component contains about 0.1 to about 10% of low molecular weight polar compound, all percentages being by weight based on the weight of the composition.

2. A marker device according to claim 1 wherein said polymeric component comprises a polar polymer.

3. A marker device in accordance with claim 1, wherein said polymeric component comprises a polar olefin copoloymer.

4. A marker device in accordance with claim 3, wherein said polymeric component comprises an ethylene-alkyl acrylate copolymer.

5. A marker device in accordance with claim 4, wherein said polymeric component comprises an ethylene-ethyl acrylate copolymer or an ethylene methylacrylate copolymer.

6. A marker device in accordance with claim 4, wherein said polymeric component comprises an ethylene methyl acrylate copolymer.

7. A marker device in accordance with claim 1, wherein said polymeric component comprises a blend of polyethylene and a polar polymer, in which the polar polymer predominates forming the major phase.

8. A marker device in accordance with claim 1, wherein said polymeric component comprises polyethylene and a low molecular weight polar compound.

9. A marker device in accordance with claim 1, wherein said polymeric component comprises a blend of polyethylene and a polar polymer, in which polyethylene is the major phase, and a low molecular weight polar compound.

10. A marker device in accordance with claim 1 or claim 8, wherein said low molecular weight compound is selected from the group consisting of hindered phenols, acrylates, phthalates, cyanurates, isocyanurates and mixtures thereof.

11. A marker device in accordance with claim 1, wherein said active filler is selected from the group consisting of talc, clay, fumed or precipitated silica, aluminosilicates and mixtures thereof.

12. A marker device in accordance with claim 1, wherein said active filler is a mixture of fumed or precipitated silica and talc.

13. A marker device in accordance with claim 1, wherein said inert filler is present in an amount of 5 to about 60%, by weight, based on the weight of the composition.

14. A marker device in accordance with claim 1, wherein said inert filler is selected from the group consisting of calcium carbonate, powdered PTFE, decabromodiphenyl ether, perchloropentacyclodecane, 2,2-bis (tetrabromophthalimido) ethylene, titanium dioxide, antimony trioxide, zinc hydroxide, zinc borate, zinc oxide, zinc sulfide, magnesium hydroxide, basic magnesium carbonate, iron oxide and mixtures thereof.

15. A marker device in accordance with claim 1, which is in the form of an extruded sheet.

16. A marker device in accordance with claim 1, which is in the form of a polymeric tube.

17. A marker device in accordance with claim 6, which is heat recoverable.

18. A marker device in accordance with claim 1, wherein said indicia are resistant to organic solvents, smearing and abrasion in the absence of heat treatment of the article subsequent to placing the indicia thereon.

19. A method for producing an article having permanent indicia thereon, which method comprises:

A. selecting an article formed by extruding a composition comprising:

a. about 35 to about 75% of a polymeric component having dispersed therein about 25 to about 65% of a filler component comprising:

i. about 2 to about 65% of an insoluble, infusible particulate, active filler having a means particle size less than about 2.5 micron and a surface area greater than about 10 $m^2/g$: and ii. up to about 63% of an insoluble, infusible, particulate, inert filler;

with the proviso that if the polymer of the polymeric component is nonpolar, said polymeric component contains about 0.1 to about 10% of low molecular weight polar compound, all percentages being by weight based on the weight of the composition; and B. applying ink to a surface of said article to obtain permanent indicia thereon.

* * * * *